US008602510B2

(12) United States Patent
Currle et al.

(10) Patent No.: US 8,602,510 B2
(45) Date of Patent: Dec. 10, 2013

(54) ATTACHMENT RAIL SYSTEM FOR HOUSEHOLD APPLIANCE

(75) Inventors: Andreas Currle, New Bern, NC (US); Kevin W. Sherbert, New Bern, NC (US); James O'Neal Taylor, Jacksboro, TN (US)

(73) Assignee: BSH Home Appliances Corporation, Irvine, CA (US)

( * ) Notice: Subject to any disclaimer, the term of this patent is extended or adjusted under 35 U.S.C. 154(b) by 155 days.

(21) Appl. No.: 12/967,169

(22) Filed: Dec. 14, 2010

(65) Prior Publication Data

US 2012/0146475 A1 Jun. 14, 2012

(51) Int. Cl.
*A47B 83/00* (2006.01)

(52) U.S. Cl.
USPC ..... 312/237

(58) Field of Classification Search
USPC ..... 312/237, 350, 334.27, 242, 198, 351, 312/352, 111, 334.6, 334.7, 334.14, 312/334.24; 68/3 R; 248/678, 680, 346.01, 248/500
See application file for complete search history.

(56) References Cited

U.S. PATENT DOCUMENTS

| | | | | | |
|---|---|---|---|---|---|
| 1,602,383 | A | * | 10/1926 | Andersson | 312/111 |
| 1,743,273 | A | * | 1/1930 | Hammer | 312/242 |
| 3,169,813 | A | * | 2/1965 | Cannon et al. | 312/270.3 |
| 3,304,032 | A | * | 2/1967 | Yates | 248/649 |
| 3,866,867 | A | * | 2/1975 | LaRocca | 248/646 |
| 3,964,705 | A | * | 6/1976 | Giovanni | 248/27.1 |
| 4,152,034 | A | * | 5/1979 | Dunning, III | 312/204 |
| 4,539,737 | A | * | 9/1985 | Kerpers et al. | 29/423 |
| 4,580,853 | A | * | 4/1986 | Hitzeroth et al. | 312/245 |
| 5,076,525 | A | * | 12/1991 | Whipple | 248/300 |
| 5,219,191 | A | * | 6/1993 | Wolter | 292/157 |
| 5,584,550 | A | * | 12/1996 | Kueng | 312/334.6 |
| 5,624,098 | A | * | 4/1997 | McDowell | 248/550 |
| 5,785,397 | A | * | 7/1998 | Pavelski | 312/111 |
| 5,967,634 | A | * | 10/1999 | Baca | 312/242 |
| 6,045,205 | A | * | 4/2000 | Dingler | 312/351.7 |
| 6,142,596 | A | * | 11/2000 | Carson | 312/334.39 |
| 6,740,851 | B2 | * | 5/2004 | Woodlief et al. | 219/421 |
| 7,401,757 | B2 | * | 7/2008 | Lomp | 248/681 |

(Continued)

FOREIGN PATENT DOCUMENTS

| | | | | | |
|---|---|---|---|---|---|
| JP | 09154637 | A | * | 6/1997 | A47B 5/02 |

OTHER PUBLICATIONS

JP9154637 Translation.*

*Primary Examiner* — Janet M Wilkens
*Assistant Examiner* — Andrew Roersma
(74) *Attorney, Agent, or Firm* — James E. Howard; Andre Pallapies

(57) ABSTRACT

An attachment system for attaching a household appliance to a cabinet. The system includes a base having a main body for attaching to the cabinet, front and rear lugs that project substantially horizontally from and are elevated relative to a support area of the cabinet, and a rail catch projecting from the positioning base; and a rail adapted to be attached to a side of the appliance. The rail has a lip that engages the rail catch and limits movement of the rail in a vertical direction, a rear engagement area that engages the rear lug in the installed position, and a front engagement area that engages the front lug in an installing position and in the installed position. The front engagement area has a notch in which the front lug rests in the installed position, and a ramp sloping downward from the notch toward the rear engagement area.

27 Claims, 5 Drawing Sheets

(56) References Cited

U.S. PATENT DOCUMENTS

| | | | | |
|---|---|---|---|---|
| 7,685,846 | B2 * | 3/2010 | Hwang et al. | 68/3 R |
| 2005/0139738 | A1 * | 6/2005 | Hwang et al. | 248/188.1 |
| 2006/0065265 | A1 * | 3/2006 | Erdmann et al. | 126/339 |
| 2008/0185941 | A1 * | 8/2008 | Geiger et al. | 312/223.1 |
| 2009/0026903 | A1 * | 1/2009 | Laible | 312/334.8 |
| 2009/0183360 | A1 * | 7/2009 | Hasslberger et al. | 29/700 |
| 2009/0218471 | A1 * | 9/2009 | Kempte et al. | 248/500 |
| 2011/0284711 | A1 * | 11/2011 | Hsiao | 248/346.03 |

* cited by examiner

ATTACHMENT RAIL SYSTEM FOR HOUSEHOLD APPLIANCE

FIELD OF THE INVENTION

The invention is directed to an attachment rail system for a household appliance, and, more particularly, to an attachment rail system that facilitates installation and removal of the appliance from a cabinet.

An example of an application for the invention is an attachment rail system for a cabinet mounted household oven.

BACKGROUND OF THE INVENTION

Many home appliances, such as, for example, ovens, are mounted in cabinets or other structures. Many of these cabinets or other structures are high quality, visually pleasing and expensive. It can be difficult and time consuming to position a household appliance such as an oven in a built-in installation using conventional attachment systems. Often the support surface (such as a shelf) on which the appliance is positioned is not level and/or is not parallel/perpendicular to the edges of the cabinet that are visible after the installation is complete. This leads to either unsightly alignment or a difficult alignment process that can be time consuming.

Some appliances that are designed to be built-in to a cabinet simply rest on a shelf or other support surface of the cabinet. Other appliances are fixed to the cabinet by screws or some type of latching system. Installing such appliances often involves using shims of different thicknesses between the appliance and the support surface of the cabinet in order to properly position the appliance relative to the cabinet. This process can require repeatedly placing shims in the cabinet, placing the appliance in the cabinet, removing the appliance from the cabinet, repositioning/replacing the shims, and replacing the appliance in the cabinet. Because some cabinets are susceptible to scratching and marring, this process can result in permanent damage to the cabinet face that is unacceptable to the end user.

SUMMARY

The invention recognizes that it is desirable to provide an attachment system that is easy to install and that facilitates the trial and error method that is often required to properly position an appliance in a cabinet or other structure. Exemplary embodiments of the invention provide an attachment rail system that simultaneously moves the appliance forward and upward as the appliance is moved out of the cabinet. These embodiments reduce the likelihood during installation and removal of the cabinet face being marked by the appliance or a trim ring that is often attached to the appliance.

Particular embodiments of the invention are directed to an attachment system for attaching a household appliance to a cabinet in an installed position. The system includes a positioning base and a rail. The positioning base has a main body for attaching to a support area of the cabinet, a front lug that projects substantially horizontally from the positioning base, the front lug being elevated relative to the support area of the cabinet, a rear lug that projects substantially horizontally from the positioning base, the rear lug being elevated relative to the support area of the cabinet, and a rail catch projecting from the positioning base. The rail is adapted to be attached to a side of the appliance, the rail having an engagement lip that engages the rail catch and limits movement of the rail in a vertical direction, a rear engagement area that engages the rear lug in the installed position, and a front engagement area that engages the front lug in an installing position and in the installed position. The front engagement area has a notch in which the front lug rests in the installed position, and a ramp sloping downward from the notch toward the rear engagement area.

Other embodiments of the invention are directed to a cabinet for containing a household appliance. The cabinet includes a cabinet body having an appliance receiving area; a positioning base; and a rail adapted to be attached to a side of the appliance. The positioning base having a main body attached to a support area of the receiving area, a front lug that projects substantially horizontally from the positioning base, the front lug being elevated relative to the support area, a rear lug that projects substantially horizontally from the positioning base, the rear lug being elevated relative to the support area, and a rail catch projecting from the positioning base. The rail has an engagement lip that engages the rail catch and limits movement of the rail in a vertical direction, a rear engagement area that engages the rear lug in an installed position, and a front engagement area that engages the front lug in an installing position and in the installed position. The front engagement area has a notch in which the front lug rests in the installed position, and a ramp sloping downward from the notch toward the rear engagement area.

Other embodiments of the invention are directed to a cabinet/appliance combination. Combination includes a household appliance and a cabinet. The cabinet has a cabinet body having an appliance receiving area, a positioning base positioned in the receiving area and positioning the appliance in the cabinet, and a rail. The positioning base has a main body attached to a support area of the receiving area, a front lug that projects substantially horizontally from the positioning base, the front lug being elevated relative to the support area, a rear lug that projects substantially horizontally from the positioning base, the rear lug being elevated relative to the support area, and a rail catch projecting from the positioning base. The rail is attached to a side of the appliance, and has an engagement lip that engages the rail catch and limits movement of the rail in a vertical direction, a rear engagement area that engages the rear lug in an installed position, and a front engagement area that engages the front lug in an installing position and in the installed position. The front engagement area has a notch in which the front lug rests in the installed position, and a ramp sloping downward from the notch toward the rear engagement area

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the exemplary embodiments and further features and advantages thereof may be acquired by referring to the following description taken in conjunction with the accompanying drawings, wherein.

DETAILED DESCRIPTION

The invention is described herein with reference to the accompanying drawings in which exemplary embodiments of the invention are shown. The invention may, however, be embodied in many different forms and should not be construed as limited to the embodiments set forth herein.

Figure 1:
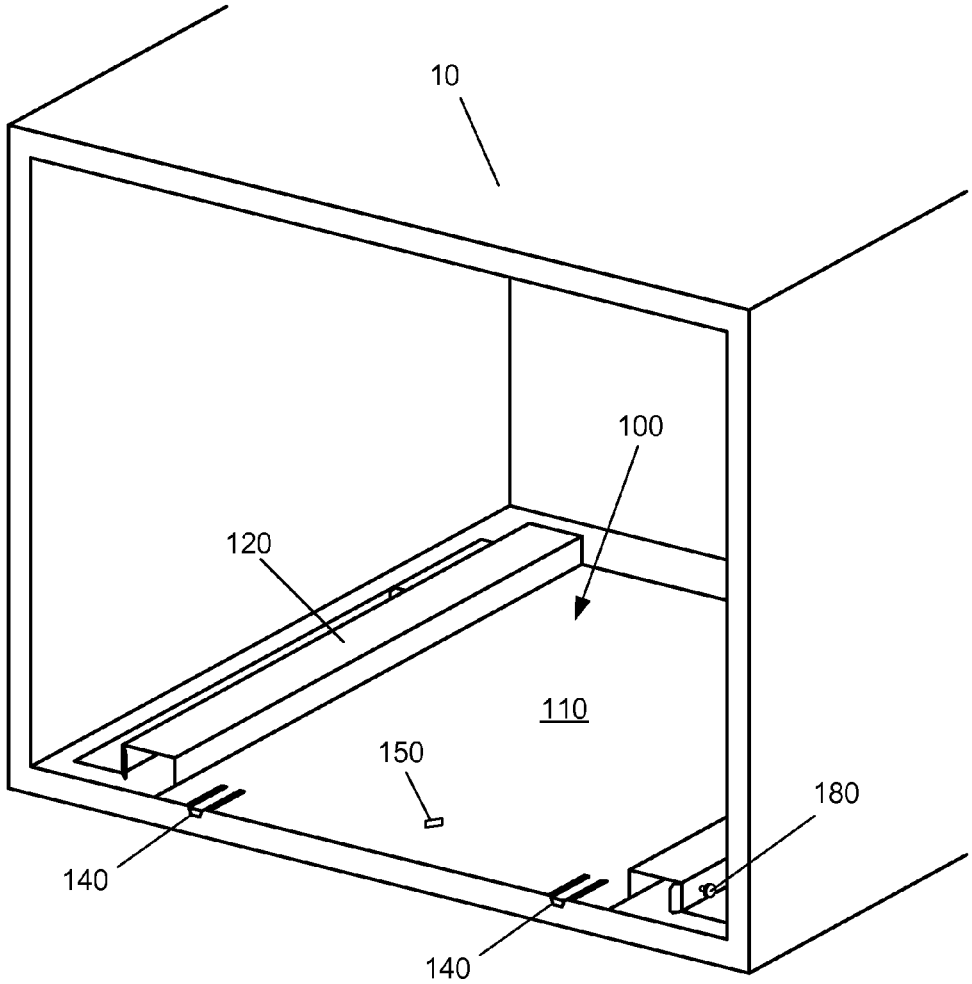
FIG. 1 is a perspective view of a cabinet and positioning base in accordance with an exemplary embodiment of the invention.

FIG. 1 shows a cabinet 10 having an internal space that can be occupied by a household appliance. FIG. 1 shows a positioning base 100 located in the internal space of cabinet 10. Positioning base 100 has several locating features that assist in properly locating positioning base 100 in cabinet 10. In this example, positioning base 100 has two edge guides 140 at its front edge which overhang a front edge of a support surface, or shelf, of cabinet 10. Positioning base 100 is pushed rearwardly into the internal space of cabinet 10 until edge guides 140 contact the front edge of the support surface or cabinet. In this example, positioning base 100 also has two locating diamonds 150 that are holes in a main body 110 of positioning base 100. A center line can be drawn on the support surface, or shelf, of cabinet 10 prior to inserting positioning base 100 into cabinet 10. The center line can be seen through locating diamonds 150 and positioning base 100 can be moved until the center line is centered in locating diamonds 150. Positioning base 100 has two elevated sections 120 that are elevated above the support surface or shelf.

Figure 2:
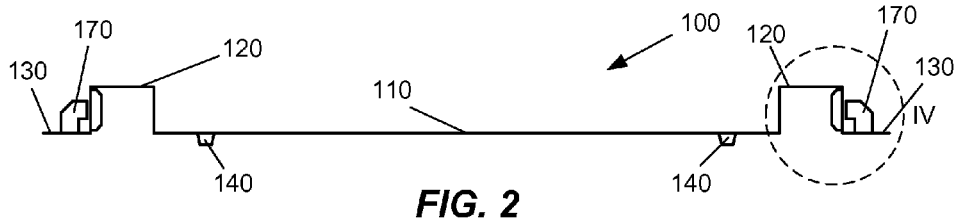
FIG. 2 is a front view of a positioning base in accordance with an exemplary embodiment of the invention.
Figure 3:
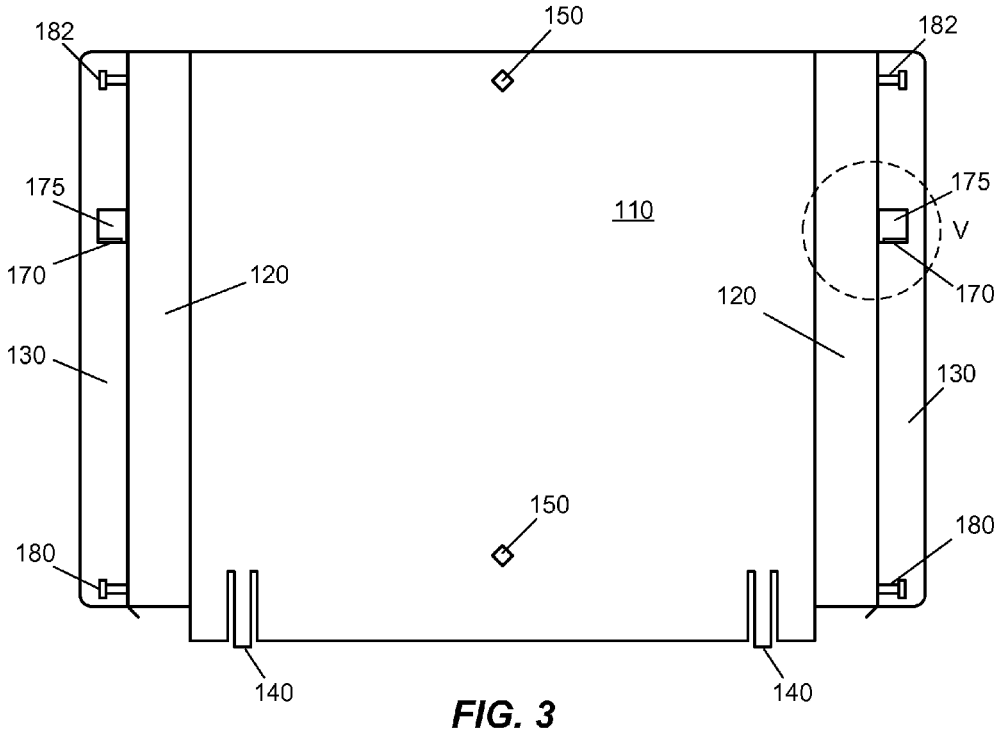
FIG. 3 is a top view of a positioning base in accordance with an exemplary embodiment of the invention.

FIGS. 2 and 3 show a front view and a top view, respectively, of positioning base 100. In this embodiment, positioning base 100 is formed from a single sheet of material such as, for example, stainless steel. Positioning base 100 has a flat main body 110 and side sections 130 that are designed to sit flat on a support surface, or shelf, of cabinet 10. Elevated sections 120 extend upwardly from main body 110.

Shown in FIG. 3 are two front lugs 180 and two rear lugs 182 that project outwardly from the sides of elevated sections 120. Lugs 180, 182 are omitted from FIG. 2 so as not to obscure other features in the figure. Lugs 180, 182 provide engagement points for rails that can be mounted to the appliance that is to be positioned on positioning base 100. Also shown in the figures are two rail catches 170 that interact with rails mounted to the appliance. The functioning of the rails will be discussed below.

Figure 4:
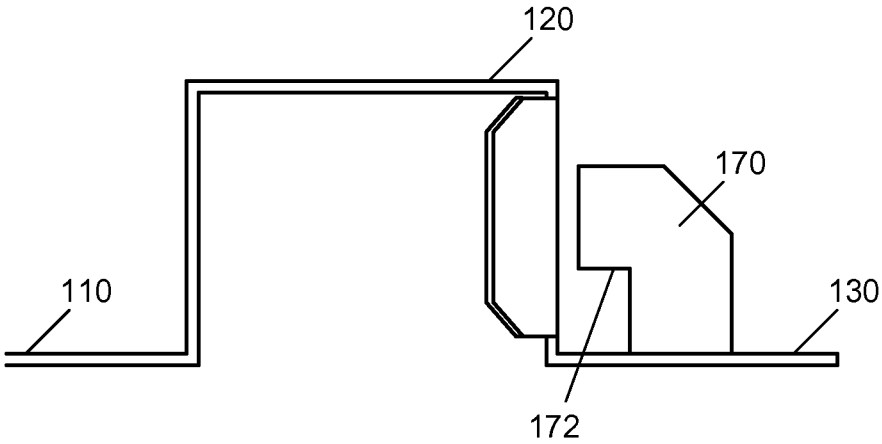
FIG. 4 is a magnified view of the area encircled in FIG. 2.

FIG. 4 is a magnified view of the encircled area labeled IV in FIG. 2. FIG. 4 shows rail catch 170 which has a catch edge 172 that interacts with the rail mounted to the appliance.

Figure 5:
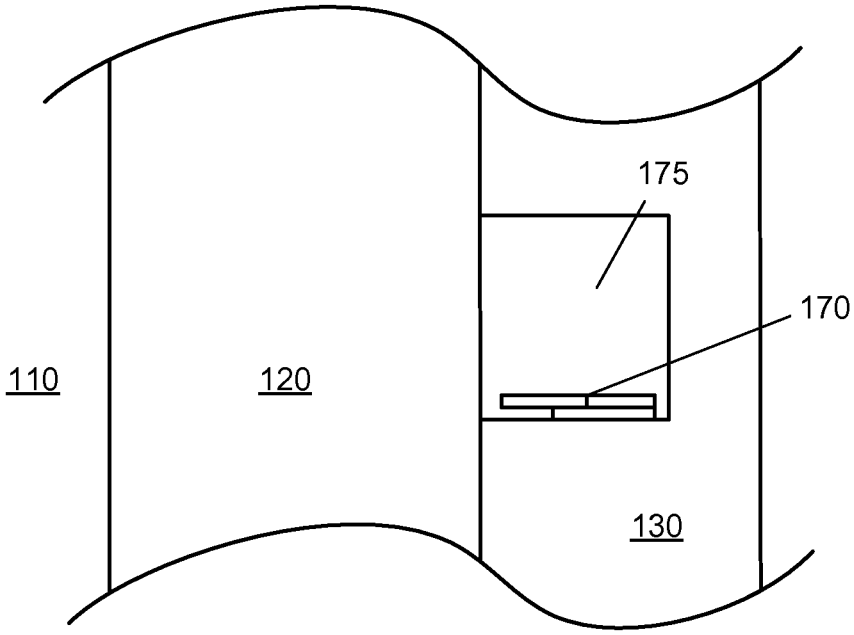
FIG. 5 is a magnified view of the area encircled in FIG. 3.

FIG. 5 is a magnified view of the encircled area labeled V in FIG. 3. FIG. 5 shows rail catch 170 and a hole 175 in side section 130. In this example, hole 175 results from rail catch 170 being formed from material punched from side section 130.

Figure 6:
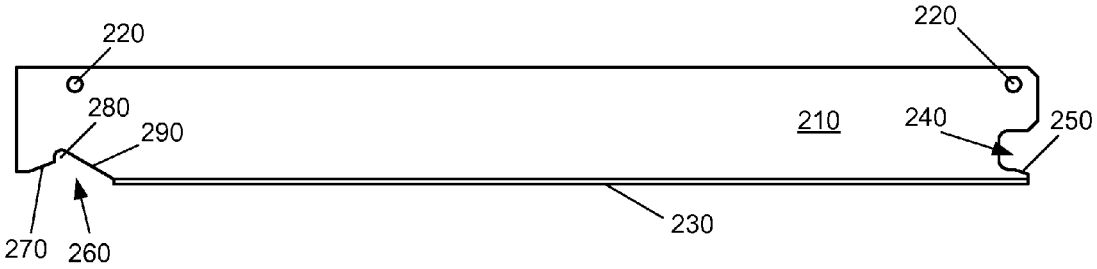
FIG. 6 is a side view of a rail in accordance with an exemplary embodiment of the invention.
Figure 7:
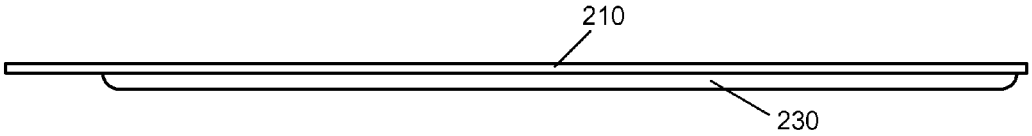
FIG. 7 is a top view of the rail shown in FIG. 6.

FIGS. 6 and 7 show an example of a rail 210 that can be attached to an appliance that is to be positioned in cabinet 10. FIG. 6 is a side view of rail 210 and FIG. 7 is a top view of rail 210. In some embodiments, one such rail is mounted to an opposite side of the appliance. The rail shown in FIGS. 6 and 7 would be mounted to a right side of an appliance (looking at the front of the appliance). The rail that would be mounted to the left side of the appliance would be a mirror image of rail 210.

Rail 210 is shown here with a pair of locating/attachment holes 220 that are for locating and/or attaching rail 210 to the appliance. Rail 210 has an engagement lip 230 that extends out of the paper in FIG. 6 and downwardly in FIG. 7. Engagement lip 230 engages rail catch 170 when the appliance is moved into the installed position.

Rail 210 has a rear engagement area 240 that engages rear lug 182 when the appliance is in the installed position. The edges of rear engagement area 240 may or may not touch rear lug 182 when the appliance is in the installed position. However, rear engagement area 240 does define a limit to how far the appliance can be inserted into cabinet 10. Rear engagement area 240 includes a sloped section 250 that can assist in guiding rear lug 182 into rear engagement area 240.

Rail 210 has a front engagement area 260 that engages front lug 180 when the appliance is in the installed position as well as when the appliance is in the final stages of being installed. Front engagement area 260 has a sloped section 270, a notch 280, and a ramp 290. Notch 280 rests on front lug 180 when the appliance is in the installed position. As the appliance is moved into cabinet 10, the bottom of rail 210 (which is also the bottom of engagement lip 230) rides along the top of front lug 180. As the appliance is moved farther back into cabinet 10, engagement lip 230 is guided under catch edge 172 of rail catch 170. As movement of the appliance is continued farther into cabinet 10, ramp 290 moves along the top of front lug 180 allowing the front of the appliance to move down until notch 280 rest on front lug 180. While this interaction between ramp 290 and front lug 180 is taking place, rear engagement area 240 moves around rear lug 182. This interaction can be seen in FIG. 8.

Figure 8:
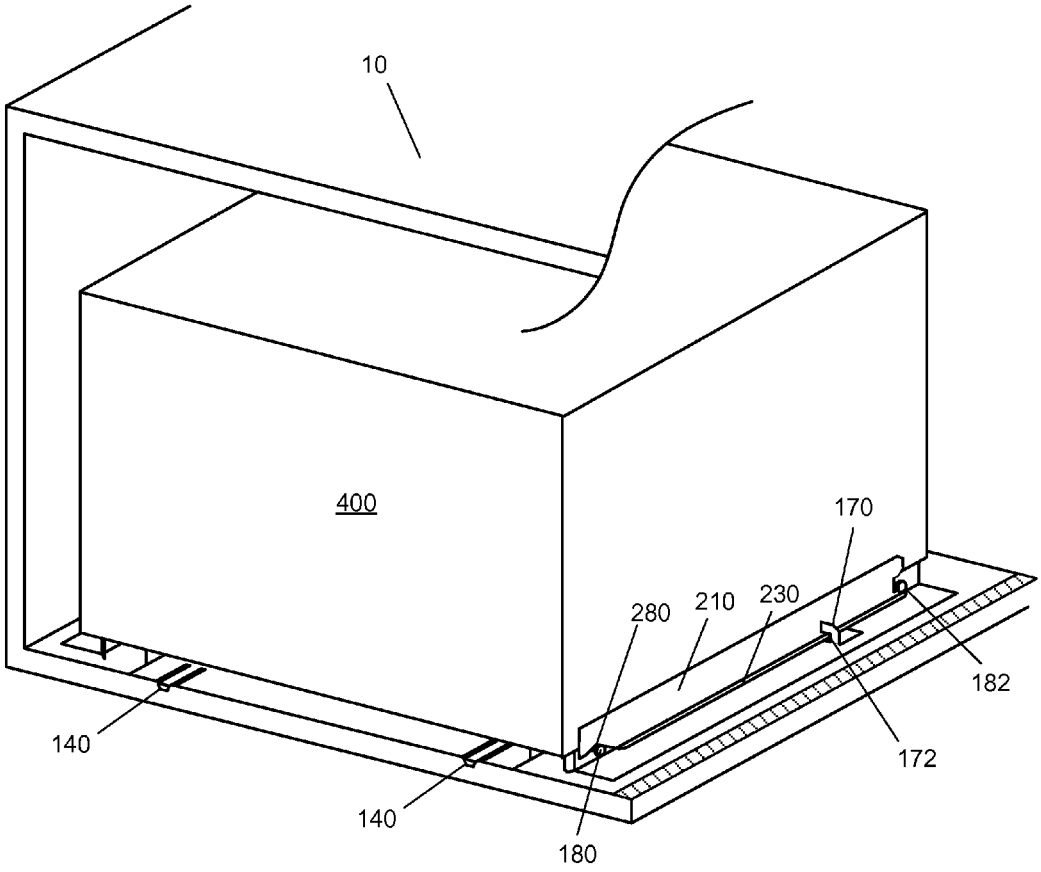
FIG. 8 is a perspective view of an appliance/cabinet combination in accordance with an exemplary embodiment of the invention.

FIG. 8 shows an appliance 400 in the installed position in cabinet 10. In this example, appliance 400 is supported by elevated sections 120. Part of the cabinet has been removed in the drawing so that all of rail 210 can be seen. Catch edge 172 of rail catch 170 can be seen positioned over engagement lip 230 of rail 210. This prevents appliance 400 from being lifted more than a small amount. Once engagement lip 230 is positioned under catch edge 172, rail catch 170 also prevents the front of appliance 400 from dangerously tilting downward during installation.

Systems in accordance with the invention provide easier installation of an appliance installed in a cabinet because rail catch 170 prevents unwanted tipping during installation. Systems in accordance with the invention also provide a more controlled installation and removal of the appliance because ramp 290 of rail 210 causes the appliance to move horizontally and vertically simultaneously. This helps prevent marking of the face of the cabinet because as front lug 180 is moved away from notch 280 (which is an upward vertical movement), the appliance is simultaneously moved away from the face of the cabinet. This also works as the appliance is moved into the installed position because as notch 280 is moved downward over front lug 180, the appliance is simultaneously moved into the cabinet the final small distance. Built-in appliances such as, for example, ovens are often heavy and cumbersome. It can be very difficult to hold an appliance off of the face of the cabinet while making the final movement into the cabinet. Systems in accordance with the invention assist in this final small movement by providing the described interaction between front lug 180 and ramp 290.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the invention.

What is claimed is:

1. An attachment system for attaching a household appliance to a cabinet in an installed position, the system comprising:

a positioning base having a main body for attaching to a support area of the cabinet, a front lug that projects substantially horizontally from the positioning base, the front lug being elevated relative to the main body, a rear lug that projects substantially horizontally from the positioning base, the rear lug being elevated relative to the main body, and a rail catch projecting from the positioning base; and a rail adapted to be attached to a side of the appliance, the rail having an engagement lip that engages the rail catch and limits movement of the rail in a vertical direction, but permits movement of the rail in an appliance insertion direction, the appliance insertion direction being a direction in which the rail moves when the appliance is inserted into the cabinet, a rear engagement area that engages the rear lug in the installed position, and a front engagement area that engages the front lug in an installing position and in the installed position, the front engagement area having a notch in which the front lug rests in the installed position, and a ramp sloping downward from the notch toward the rear engagement area, wherein the rail catch has a portion that projects horizontally in a direction that is non-parallel to the insertion direction.

2. The system of claim 1, wherein a first section of the ramp is defined by a line tangent to a surface of the notch that rests on the front lug in the installed position.

3. The system of claim 2, wherein the ramp is adapted to slide on the front lug as the rail is moved from the installing position to the installed position.

4. The system of claim 3, wherein the positioning base further comprises an elevated section, an upper surface of the elevated section being located vertically above where the main body is adapted to contact the support area of the cabinet, the elevated section being adapted to support the appliance in the installed position.

5. The system of claim 4, wherein the front lug and the rear lug project substantially horizontally from the elevated section.

6. The system of claim 5, wherein the rail catch is located between the front lug and the rear lug, and the rail catch is located closer to the rear lug than the front lug.

7. The system of claim 3, comprising two of the rails, two of the front lugs, and two of the rear lugs, a first one of the rails being adapted to be attached to a first side of the appliance and a second one of the rails being adapted to be attached to a second side of the appliance that is opposite to the first side of the appliance.

8. A cabinet for containing a household appliance, the cabinet comprising:

a cabinet body having an appliance receiving area;

a positioning base having a main body attached to a support area of the receiving area, a front lug that projects substantially horizontally from the positioning base, the front lug being elevated relative to the support area, a rear lug that projects substantially horizontally from the positioning base, the rear lug being elevated relative to the support area, and a rail catch projecting from the positioning base; and a rail adapted to be attached to a side of the appliance, the rail having an engagement lip that engages the rail catch and limits movement of the rail in a vertical direction, but permits movement of the rail in an appliance insertion direction, the appliance insertion direction being a direction in which the rail moves when the appliance is inserted into the cabinet, a rear engagement area that engages the rear lug in an installed position, and a front engagement area that engages the front lug in an installing position and in the installed position, the front engagement area having a notch in which the front lug rests in the installed position, and a ramp sloping downward from the notch toward the rear engagement area, wherein the rail catch has a portion that projects horizontally in a direction that is non-parallel to the insertion direction.

9. The cabinet of claim 8, wherein a first section of the ramp is defined by a line tangent to a surface of the notch that rests on the front lug in the installed position.

10. The cabinet of claim 9, wherein the ramp is adapted to slide on the front lug as the rail is moved from the installing position to the installed position.

11. The cabinet of claim 10, wherein the positioning base further comprises an elevated section, an upper surface of the elevated section being located vertically above the support area of the cabinet, the elevated section being adapted to support the appliance in the installed position.

12. The cabinet of claim 11, wherein the front lug and the rear lug project substantially horizontally from the elevated section.

13. The cabinet of claim 12, wherein the rail catch is located between the front lug and the rear lug, and the rail catch is located closer to the rear lug than the front lug.

14. The cabinet of claim 10, comprising two of the rails, two of the front lugs, and two of the rear lugs, a first one of the rails being adapted to be attached to a first side of the appliance and a second one of the rails being adapted to be attached to a second side of the appliance that is opposite to the first side of the appliance.

15. A cabinet/appliance combination comprising:

a household appliance; and a cabinet, the cabinet having a cabinet body having an appliance receiving area;

a positioning base positioned in the receiving area, the base locating the household appliance in the cabinet, the base having a main body attached to a support area of the receiving area, a front lug that projects substantially horizontally from the positioning base, the front lug being elevated relative to the support area, a rear lug that projects substantially horizontally from the positioning base, the rear lug being elevated relative to the support area, and a rail catch projecting from the positioning base; and a rail attached to a side of the appliance, the rail having an engagement lip that engages the rail catch and limits movement of the rail in a vertical direction, but permits movement of the rail in an appliance insertion direction, the appliance insertion direction being a direction in which the rail moves when the appliance is inserted into the cabinet, a rear engagement area that engages the rear lug in an installed position, and a front engagement area that engages the front lug in an installing position and in the installed position, the front engagement area having a notch in which the front lug rests in the installed position, and a ramp sloping downward from the notch toward the rear engagement area, wherein the rail catch has a portion that projects horizontally in a direction that is non-parallel to the insertion direction.

16. The combination of claim 15, wherein a first section of the ramp is defined by a line tangent to a surface of the notch that rests on the front lug in the installed position.

17. The combination of claim 16, wherein the ramp is adapted to slide on the front lug as the rail is moved from the installing position to the installed position.

18. The combination of claim 17, wherein the positioning base further comprises an elevated section, an upper surface of the elevated section being located vertically above the support area of the cabinet, the elevated section supporting the appliance in the installed position.

19. The combination of claim 18, wherein the front lug and the rear lug project substantially horizontally from the elevated section.

20. The combination of claim 19, wherein the rail catch is located between the front lug and the rear lug, and the rail catch is located closer to the rear lug than the front lug.

21. The combination of claim 17, comprising two of the rails, two of the front lugs, and two of the rear lugs, a first one of the rails being attached to a first side of the appliance and a second one of the rails being attached to a second side of the appliance that is opposite to the first side of the appliance.

22. The system of claim 1, wherein the rear engagement area includes a notch that is open toward the rear of the rail, and the engagement lip extends below the notch so that the notch is closed from below.

23. The cabinet of claim 8, wherein the rear engagement area includes a notch that is open toward the rear of the rail, and the engagement lip extends below the notch so that the notch is closed from below.

24. The combination of claim 15, wherein the rear engagement area includes a notch that is open toward the rear of the rail, and the engagement lip extends below the notch so that the notch is closed from below.

25. The system of claim 1, wherein the ramp supports the front lug so that the rail tilts relative to the positioning base as the rail is moved from the installing position to the installed position.

26. The cabinet of claim 8, wherein the ramp supports the front lug so that the rail tilts relative to the positioning base as the rail is moved from the installing position to the installed position.

27. The combination of claim 15, wherein the ramp supports the front lug so that the rail tilts relative to the positioning base as the rail is moved from the installing position to the installed position.

* * * * *